US005322614A

United States Patent [19]

May et al.

[11] Patent Number: 5,322,614

[45] Date of Patent: Jun. 21, 1994

[54] DEVICE FOR ELECTROLYTIC DEPOSITION OF METALS ON ONE OR BOTH SIDES OF STRIPS

[76] Inventors: Hans J. May, Ulmenweg 17, D-5860 Iserlohn; Roland Schnettler, Schwerter Styr. 138, D-5800 Hagen, both of Fed. Rep. of Germany

[21] Appl. No.: 720,810

[22] PCT Filed: Jan. 20, 1990

[86] PCT No.: PCT/DE90/00035

§ 371 Date: Aug. 6, 1991

§ 102(e) Date: Aug. 6, 1991

[87] PCT Pub. No.: WO90/08209

PCT Pub. Date: Jul. 26, 1990

[30] Foreign Application Priority Data

Jan. 21, 1989 [DE] Fed. Rep. of Germany ..... 3901807

[51] Int. Cl.[5] ..... C25D 5/02; C25D 7/06

[52] U.S. Cl. ..... 205/96; 205/130; 205/138

[58] Field of Search ..... 205/96, 130, 138; 204/211

[56] References Cited

U.S. PATENT DOCUMENTS 3,522,166 7/1970 Jones ..... 204/206
3,880,725 4/1975 Van Raalte et al. ..... 204/15
3,970,537 7/1976 Froman et al. ..... 204/211
4,240,881 12/1980 Stahya ..... 204/28
4,347,115 8/1982 Espenhahn et al. ..... 204/206
4,597,837 7/1986 Oda et al. ..... 204/14.1

FOREIGN PATENT DOCUMENTS 3017079 11/1981 Fed. Rep. of Germany .
63-259098 2/1989 Japan .
1-17890 5/1989 Japan .

*Primary Examiner*—John Niebling
*Assistant Examiner*—William T. Leader
*Attorney, Agent, or Firm*—Collard & Roe

[57] ABSTRACT

In a process for the electrolytic deposition of metal on one side of a strip, preferably a steel strip which forms the cathode, the section (7) of the strip to be coated is guided through a gap between two parallel anodes (3,4) which are insoluble in the electrolyte (6). A voltage can be applied to the anodes (3,4) independently of each other. One of the two anodes is subdivided perpendicular to the direction of motion of the strip into several sections (41, 42, 43, 44) electrically insulated from each other. Voltages are selectively and independently applied to the anode sections to prevent the side of the strip facing the anode sections from being permanently coated and to prevent passivation of the anode sections.

1 Claim, 1 Drawing Sheet

DEVICE FOR ELECTROLYTIC DEPOSITION OF METALS ON ONE OR BOTH SIDES OF STRIPS

BACKGROUND OF THE INVENTION

1. Field of Invention

The invention relates to a device and process for electrolytic deposition of metals on one or both sides of strips which form the cathode, preferably steel strips.

2. The Prior Art

In horizontal or vertical galvanic systems of this type, the deposition of metals from the electrolyte takes place on strips which form the cathode, which pass through two anodes which are parallel to one another and insoluble. An electrical charge, generally rectified, is applied to the two anodes, so that the metallic precipitation on the strip passing through takes place under the known suitable conditions. Such a system is known, for example, from DE-OS 35 10 592. Such and similar devices are also used, however, for one-sided coating of the strip passing through. One of the two parallel anodes is then removed from the device. Since systems generally have several pairs of anodes arranged one after the other, through which the strip passes, this results in long setup times of the system for one-sided coating. In addition, it is frequently found that in spite of the absence of the removed anode, partial coating takes place on the side of the strip which is not supposed to be coated.

Attempts have also already been made, in order to avoid such setup times, to have no current or voltage applied to one of the two anodes in each case. In operation, however, it turns out that in such a case, a disruptive metal precipitation on the anode takes place, both on the side of the strip which is not supposed to be coated, and in the lower anode region. Depending on the anode material, e.g. in the case of iridium dioxide coated anodes, this causes the surface to be passivated in the lower region and therefore to become unusable. The explanation must obviously be seen in the fact that a voltage drop from the entry point to the exit point of the segment of the strip to be coated takes place, so that potential differences between the anode, which actually has no current applied to it, and the strip segment opposite it occur, which are obviously sufficient to trigger deposition processes in the direction of the anode and/or the strip.

It has therefore already been proposed that the current-free anode be insulated from the strip segment by intermediate placement of an insulation, for example a thin plastic sheet. However, it is frequently not possible to place such insulation sheets in the very narrow gap between the strip and the anode. Furthermore, such a measure also requires significant setup times when switching from two-side coating operation to one-sided coating operation and vice versa.

SUMMARY OF THE INVENTION

The task of the invention consists of improving a device of the type stated and its method of control, in such a way that one-sided coating is made possible with simple means, without significant metal precipitation on the side of the strip which is not supposed to be coated, or on the anode.

The task of the invention is accomplished with a device in which the strips to be coated are guided in a slot between 2 anodes which are arranged parallel to one another and are insoluble. An electric charge can be applied to the anodes independently. One of the anodes is subdivided into several segments which are electrically insulated from one another. Different electrical charges can be applied to the several segments.

According to a preferred embodiment of the invention, the corresponding anode is subdivided into several segments of the same size, where the anode segments can be held in a holder, with clear segments or insulating pieces between them.

In one-sided coating operation, no current is applied to the anode, in known manner. Since the anode according to the invention is subdivided into relatively small segments in the direction of motion of the strip to be coated, only small voltage potentials relative to the strip to be coated can build up in these segments, which are small as compared with the overall length of the anode, and such potentials are not able to trigger deposition processes from the anode or deposition processes out of the electrolyte, or only to a slight extent.

The use of an anode subdivided into multiple segments in the direction of motion of the strip, according to the invention, allows several possibilities of controlling one-sided coating operation. With certain anodes, for example anodes made of iridium dioxide, it can be practical to apply a voltage which is less than that required to trigger deposition, to the individual segments of the anode segments which are voltage-free, in other words not "working," in order to prevent from passivating the anode and, at the same time, coating of the side of the strip which is not supposed to be coated. In the individual anode segments, a suitable application of charge to the anode can be controlled.

It is also possible, with a cathode according to the invention, if its surface consists of lead, for example, to reduce any precipitation which has formed on the side not to be coated, in one-sided operation, at the end of the strip segment passing through, by deposition in the reverse direction, in that such an electrical charge is applied to the anode segments in the area of the exit region, i.e. negative relative to the opposite strip segment, that reduction of the undesirable precipitation on the side of the strip which is not supposed to be coated takes place, without any significant deposition on the corresponding anode segment occurring.

On the basis of the galvanic cell shown schematically, the invention is explained in greater detail in the following.

DETAILED DESCRIPTION OF THE PREFERRED EMBODIMENT

Figure 1:
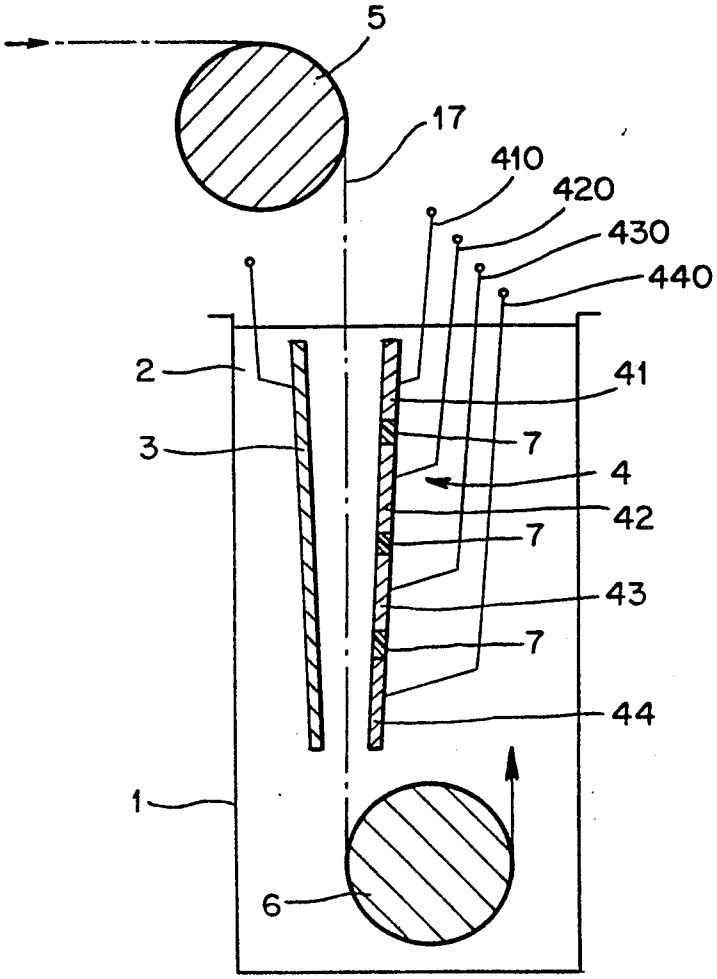
FIG. 1 is a longitudinal cross-section through a cell.
Figure 2:
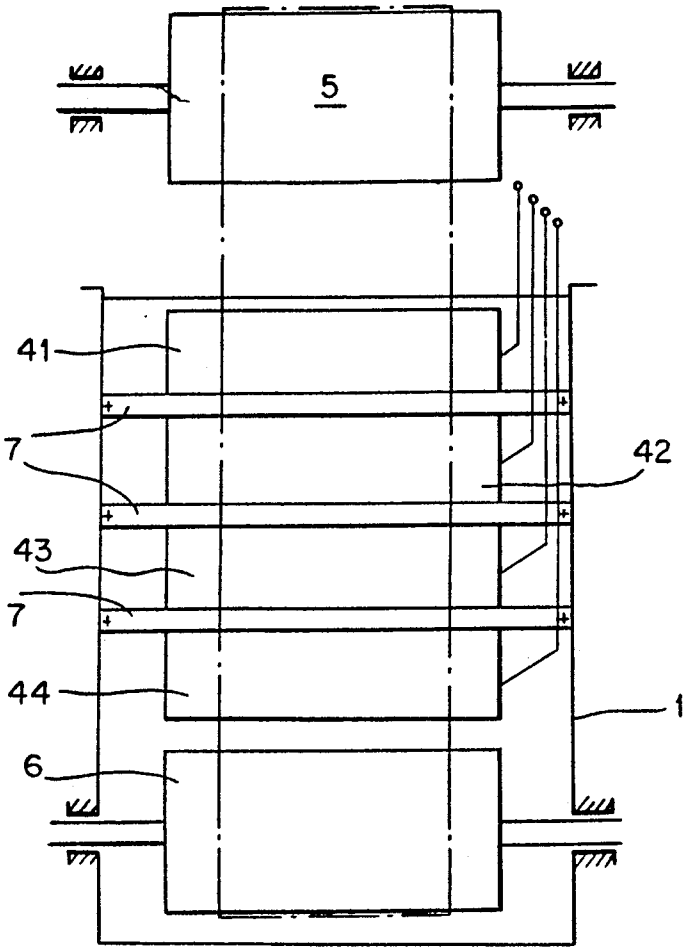
FIG. 2 is a perpendicular view relative to the cross-section in FIG. 1, of an anode in the cell, subdivided several times in the lateral direction.

The housing of such a cell is designated with the number 1. In the electrolyte bath 2, there are the two anodes 3 and 4, arranged approximately parallel to one another, where the strip 17 to be coated is guided through the gap formed between the anodes. With this vertical arrangement, the strip runs from an upper deflector roller 5, which can form the current roller, if necessary, to a lower roller 6, located in the electrolyte bath 2.

While the insoluble anode 3 is to be viewed as homogeneous over its entire length, the other insoluble anode 4 is subdivided in the direction of motion of the strip, with parallel subdividing lines. These anode segments, which preferably have the same size, are designated with the numbers 41, 42, 43 and 44. These segments are insulated from one another, for example by the interstices between them, as shown. The anode segments are held in a holder designated with the number 7. However, the electrical insulation can also be brought about by insulating segments placed between them, for example plastic segments. An electrical charge can be applied to each anode segment, by separate connections 410, 420, 430, 440. With corresponding control processes, preferably regulated and monitored, different voltages or potentials can be applied to these segments, which serve to carry out one-sided coating of a strip via the anode 3.

The processes for controlling the operation essentially serve to prevent or reduce precipitation on the side of the strip which is not supposed to be coated, during one-side coating operation.

We claim:

1. A process for electroplating one side of a steel strip cathode, comprising the steps of:

(a) providing two inert spaced apart insoluble anodes having a gap therebetween, a single one of said two anodes being divided into a plurality of segments electrically insulated from one another, said steel strip having a first side facing said anode with a plurality of segments, and a second side facing the other of said two anodes;

(b) disposing said two anodes in an electroplating bath;

(c) guiding a section of the steel strip cathode to be coated into the gap between the two anodes disposed within said bath, the section being guided in a direction transverse to the segments;

(d) electroplating the side of the steel strip facing the undivided anode; and (e) selectively and independently applying a potential to the plurality of segments to prevent said side of the steel strip facing the divided anode from being permanently coated and to prevent the divided anode from passivating, comprising:

(1) applying a potential which is less than that required to trigger cathodic coating of the steel strip cathode to the segments at the upstream end of the divided anode with respect to a said direction of movement of the section of the steel strip cathode; and (2) applying a negative potential with respect to the steel strip cathode, to the segment at the downstream end of the divided anode, so that any coating forming on the side of the steel strip cathode facing the divided anode is removed.

* * * * *